US005636873A

United States Patent [19]

Sonsteby

[11] Patent Number: 5,636,873

[45] Date of Patent: Jun. 10, 1997

[54] MEDICAL DOCUMENTATION AND ASSESSMENT APPARATUS

[75] Inventor: Kristi L. Sonsteby, 14340 Xenia St. NW., Andover, Minn. 55304

[73] Assignee: Kristi L. Sonsteby, Andover, Minn.

[21] Appl. No.: 348,846

[22] Filed: Nov. 28, 1994

[51] Int. Cl.[6] ..... B42D 15/00

[52] U.S. Cl. ..... 283/81; 283/900; 283/117; 434/262

[58] Field of Search ..... 434/262, 178, 434/433; 40/359, 360; 283/81, 101, 900, 117; 128/630, 771

[56] References Cited

U.S. PATENT DOCUMENTS 4,865,549 9/1989 Sonsteby ..... 434/262

*Primary Examiner*—Frances Han

[57] ABSTRACT

A documentation system that allows adequate control of documentation in addition to an assessment of skills of the professionals involved includes a plurality of notepads, each notepad dedicated to a particular disease process or body system. Each of the notepads has disposed therein a plurality of adhesive-backed labels, each label providing a checklist of assessment steps or an anatomical diagram of a particular body system. The labels are operable to be removed and temporarily placed on the chart of the patient during an acute episode, incident, or accident, or may be permanently placed in the patient's chart to describe adequately the patient's condition. In addition, the anatomy labels are operable to be removed from the notepad and given to the patient to assist the patient in understanding his/her disease process or medical condition. Also included is an optional Charting Reminder Tool form, operable to be placed in the patient's chart for attachment of the labels.

7 Claims, 5 Drawing Sheets

MEDICAL DOCUMENTATION AND ASSESSMENT APPARATUS

TECHNICAL FIELD OF THE INVENTION

The present invention pertains in general to documentation systems, and more particularly, to a documentation system that allows adequate control of documentation involved in the health care industry in addition to an assessment of skills of the professionals involved.

BACKGROUND OF THE INVENTION

Documentation systems in the health care field have seen increased demand due to the increasing liability in that industry. The need for documentation systems is especially acute in present day health care systems to insure that well-run institutions remain in business. This is especially true when considering the fact that larger and larger numbers of individuals are being processed by the health care systems. It is this increased number of patients that provides the increased demand for documentation.

One type of problem that occurs in the documentation procedure of present day health care institutions is that involved with the nurse/patient relationship. When a patient is entered into the hospital, it is necessary to quickly identify the patient's condition and flag this condition for the nursing staff, especially when an acute episode or accident is involved that requires specific follow-up care. Typically, the nursing staff runs in shifts, with each shift having to deal with a relatively large number of patients. To insure that there is a continuity between two shifts, it is important that each nurse entering a new shift has properly recorded all information concerning each of the patients. Typically, the only information that the nurse has on this patient is the chart. In order to adequately access a problem with the patient to determine what action to take and how often, the nurse must be able to quickly review the chart to determine the complete status of the patient and then make a determination as to what the problem is. Further, the nurse must document everything that has been done during this decision-making process. This can present a problem to any health care professional in that the appropriate medical terminology, etc., is not always fresh in their mind. This is especially true when handling a number of different anatomical systems such as the cardiovascular system, the genitourinary system, etc. To insure more complete documentation, it is desirable to provide a system whereby the health care professional can have ready access to the specific procedures that must be performed under any situation and clearly and succinctly document these procedures with the appropriate medical terminology or correct anatomical diagram.

Another type of problem that occurs in the healthcare field is that of incomplete understanding on the part of a patient of his/her own disease process. Physicians are called upon to explain a patient's problem in language which is unfamiliar and not easily understood or retained by the patient. To insure more complete understanding it is desirable to provide the patient with a clear, permanent picture of the problem along with the appropriate descriptive terminology.

SUMMARY OF THE INVENTION

The present invention disclosed and claimed herein comprises a documentation system and patient teaching tool for the medical field. The documentation system contains a plurality of notepads, with each of the notepads containing 25 identical adhesive-backed labels depicting predetermined assessment information associated with a separate and particular healthcare problem, or an anatomical diagram of a particular body system. Each label includes a title describing the contents thereof, to allow selection of the appropriate label. The appropriate label is removed from the notepad when required for an acute episode or follow-up procedure. The labels may be attached to a the chart divider, the nurse's notes, the physician's progress notes, or to the optional Charting Reminder Tool form, to be included in the patient's chart when the information therein is utilized by the medical professional in accessing a patient's condition. After the follow-up procedure is complete, the label may be removed from the patient's chart or left as a permanent part of the patient's record of care. In addition, the appropriate anatomy diagram labels are operable to be removed from the notepad and given to the patient when the diagram and medical terminology thereon is utilized in explaining to the patient his/her medical condition.

BRIEF DESCRIPTION OF THE DRAWINGS

For a more complete understanding of the present invention and the advantages thereof, reference is now made to the following description taken in conjunction with the accompanying drawings in which.

DETAILED DESCRIPTION OF THE INVENTION

Figure 1B:
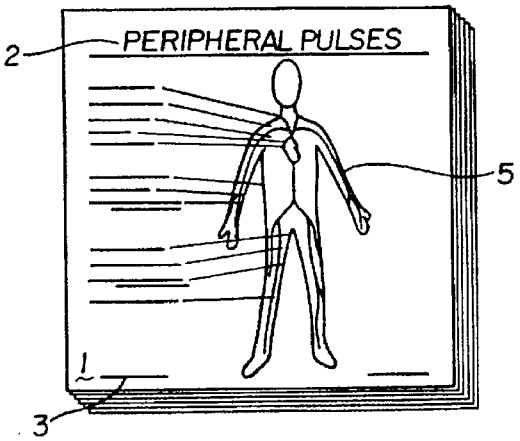
FIG. 1 illustrates a perspective blow-up of the notepads.
Figure 1E:
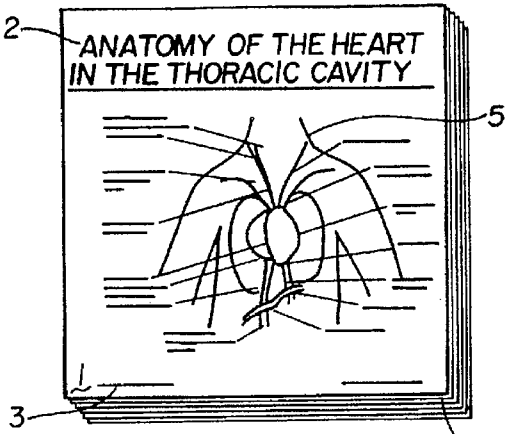
Figure 1A:
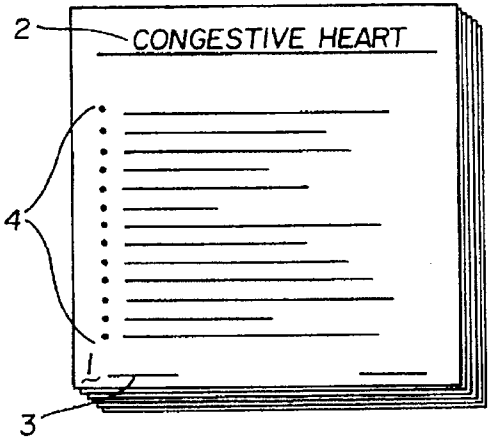
Figure 1D:
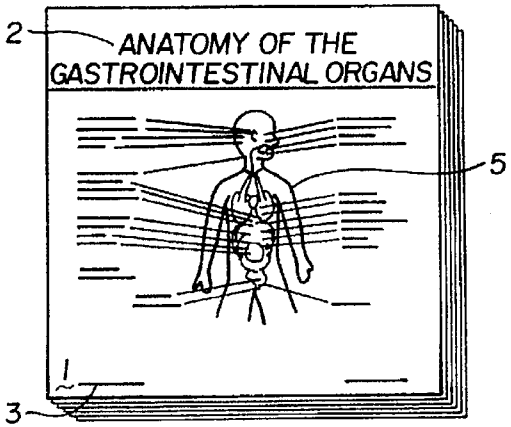
Figure 1C:
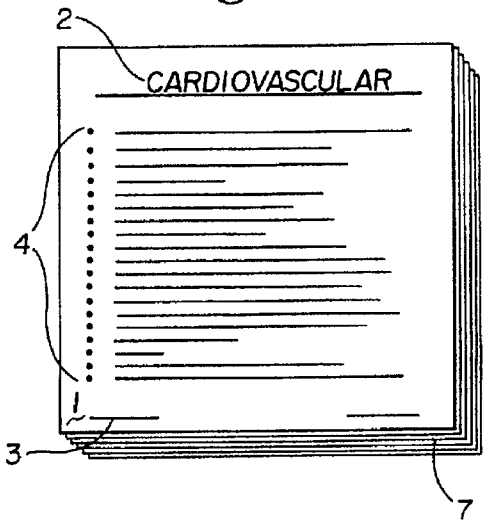

Referring now to FIG. 1 there is illustrated a perspective blow-up of the documentation system of the present invention. The documentation system is comprised of a plurality of notepads 1, each identified by a separate title 2, and a separate number, 3. Each notepad corresponds with a different body system, such as urinary or cardiovascular, and includes either a checklist 4, with all of the information necessary for a thorough assessment, or an anatomical diagram 5, with appropriate textual labels distinguishing the various body parts. In the preferred embodiment, there are at least 54 different labels, each contained in a 25-label notepad, although only five notepads are illustrated. The current labels are as follows:

#001 Blood Disorders
#002 Anemia
#003 Cancer
#004 Cardiovascular
#005 Hypertension
#006 Congestive Heart Failure (CHF)
#007 Endocrine/Metabolic
#008 Diabetes Mellitus

#009 Gastrointestinal
#010 Genitourinary
#011 Urinary Tract Infection
#012 Gynecological
#013 Anatomy of the Heart in the Thoracic Cavity
#014 Peripheral Pulses
#015 Anatomy of the Endocrine Glands
#016 Anatomy of the Gastrointestinal Organs
#017 Anatomy of the Head
#018 Anatomy of the Ear
#019 Anatomy of the Eye
#020 Female Reproductive
#021 Major Pressure Sites
#022 Anatomy of the Urinary Organs
#023 Integumentary (Skin Disorders)
#024 Musculoskeletal
#025 Fractured Hip (THR & ORIF)
#026 Neurological
#027 CVA (Stroke)
#028 Seizure Disorder
#029 Pulmonary
#030 Pneumonia
#031 Admission
#032 Air-Fluidized Therapy
#033 Colostomy/Ileostomy
#034 Decubitus/Wound Care
#035 Discharge Information
#036 Gastrostomy Feeding
#037 Heparin Lock
#038 Hickman Catheter
#039 Hyperalimentation
#040 Incident/Accident
#041 Intravenous Therapy
#042 Nasogastric Tube Feeding
#043 Oxygen Therapy
#044 Pediculosis
#045 Peritoneal Dialysis (CAPD)
#046 Suctioning (Oral/Nasopharyngeal)
#047 Tracheostomy
#048 Traction
#049 Urinary Catheterization
#050 Urostomy Care
#051 Ventilator
#052 Anatomy of the Skin
#053 Anatomy of the Pulmonary Organs
#054 Anatomy of the Lungs In use, the health care professional need only access the appropriate label by selecting the appropriate title to determine which label is to be associated with a particular patient. For example, if a patient has entered into the hospital for a cardiovascular problem, the cardiovascular notepad, 7 is selected and the appropriate label removed therefrom and attached to the patient's chart. This assessment and/or diagnostic label is then utilized to aid the health care professional in the subsequent diagnostic procedures. After the proper assessment steps have been taken and documented, the Anatomy of the Heart in the Thoracic Cavity notepad, 8 is selected and utilized when explaining to the patient his/her condition. This label is then given to the patient in order to aid his/her retention of the information.

Figure 2:
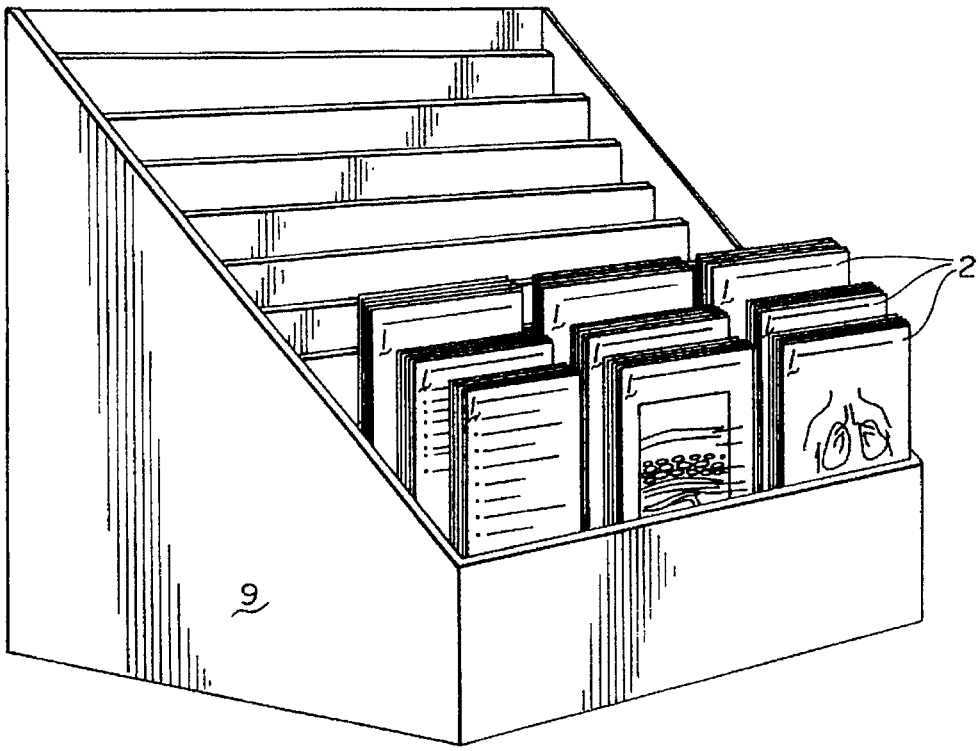
FIG. 2 illustrates a blow-up of the documentation system displayed in a rack at a nurses' station.

Referring now to FIG. 2, there is illustrated a blowup of the current invention displayed in a rack 9 at a nurses' station. The notepads 1, nine of which are shown, are placed in the display rack allowing the titles, 2 to be distinguished and the appropriate notepad to be selected.

Figure 3:
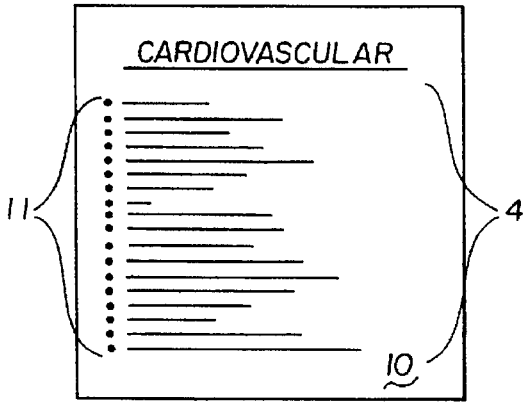
FIG. 3 illustrates a detail of a checklist label associated with the assessment portion of the present invention.

Referring now to FIG. 3, there is illustrated a detail of one of the assessment and/or diagnostic checklist labels, of which there are presently forty. This label contains the appropriate steps in proper assessment and/or documentation of the patient's condition. Each of the checklist labels, 10 has associated therewith a title, 2 that is comprised of bold letters, and a plurality of short phrases, 4 in textural format, each phrase having a "bullet", 11 associated therewith at the beginning. Each of the bullets essentially represents the beginning of a particular task or assessment tool. For the label illustrated in FIG. 3, the title 2 is illustrated as being "Cardiovascular (CV)". This represents the general assessment provided for the cardiovascular system. This indicates what must be gone through on a checklist format in order to provide an accurate assessment for change of condition, acute episode, incident or accident. For example, the label illustrated in FIG. 3 is associated with the cardiovascular system. With respect to this body system, the checklist label contains twenty steps, 4 in the proper assessment and documentation of a cardiovascular condition. This is outlined with the general medical terminology to first of all insure that the procedure has been carded out and second to provide the nurse with a guideline for documenting this procedure on the patient's chart. In the preferred embodiment, the text, 4 is illustrated in Table 1:

TABLE 1

Figure 4:
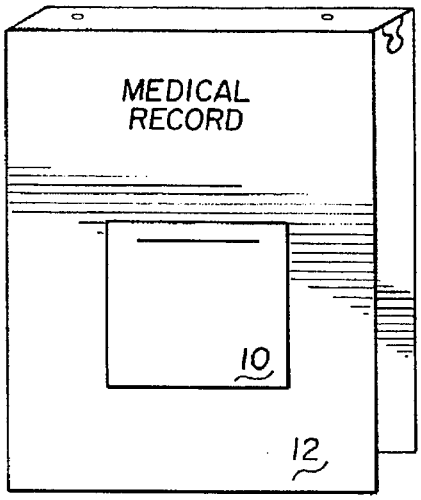
FIG. 4 illustrates the method of attachment to the patient's chart.

* Complete Vital Signs
* Notified Timely (Physician, Family/Responsible Party)
* Pain (location)
* Strength and regularity of Pulse
* Apical-Radial Deficit
* Edema—peripheral and sacral edema (1+–4+)
* Quality of bilateral and peripheral pulses
* Homan's Sign
* Therapeutic/Diagnostic Procedures
* Skin, warm and dry
* Significant changes in blood pressure
* Palpitations
* Neck vein distention
* Color (skin, nails, lips)
* Shortness of breath
* Sub-Clavian Catheter (condition)
* Pacemaker
* Equipment Necessary (Holter Monitor)
* Abnormal Heart Sounds
* Patient's knowledge of disease/procedure/procedures Each of the adhesive-backed labels is operable to be peeled off and attached to the patient's chart. This is illustrated in FIG. 4 wherein a chart 10 is associated with each patient and normally it is disposed either at the nursing station in a rack or at the patient's bedside. Typically, these charts are disposed at the nursing station and can be accessed any time a member of the professional staff is going to visit the patient for the purposes of accessing his condition and/or treatment.

In operation of the documentation system, the patient is initially assessed as to a complaint for a particular body system such as cardiovascular, genital/urinary, etc. The appropriate body system is then identified for the appropriate follow-up. For example, the associated Cardiovascular label, 10 is removed from the notepad, and placed on the front of the patient's chart 12. More than one label can be disposed thereon depending upon the various body systems that need follow-up. The chart is then placed in the appropriate area, such as near the patient or in a particular rack. The medical professional's notes are then documented each shift for follow-up on acute episode, incident accident or change of condition. Typically, this is done on a minimum period of 48–72 hours. When the episode is resolved, or follow-up is no longer necessary, the label is then peeled off or kept in the chart as a permanent record of care. Therefore, the label indicates that follow-up and documentation is necessary to insure that this action is done, in addition to providing the salient information thereon.

Figure 5:
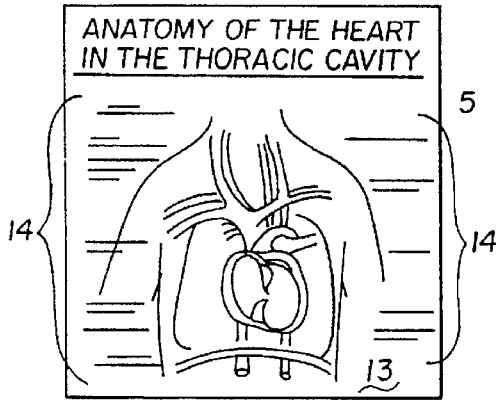
FIG. 5 illustrates one the anatomy diagram labels associated with the assessment and patient teaching portion of the present invention.

Referring now to FIG. 5, there is illustrated a detail of one of the anatomy labels, of which there are presently fourteen. The anatomy label 13, depicts an anatomical diagram, 5 of the structure of the Heart in the Thoracic Cavity and associated medical terminology, 14. In the preferred embodiment the text 14 would identify and define the body structures illustrated in Table 2:

TABLE 2

Common carotid artery
Internal jugular vein
Subclavian artery and vein
Brachiocephalic vein
Superior vena cava
Right lung
Inferior vena cava
Arch of aorta
Pulmonary artery
Base
Left lung
Apex
Pericardium (cut)
Diaphragm Thus, this anatomy diagram illustrates the proper anatomy and physiology terms and acts generally as a reminder and a patient teaching tool.

Figure 6A:
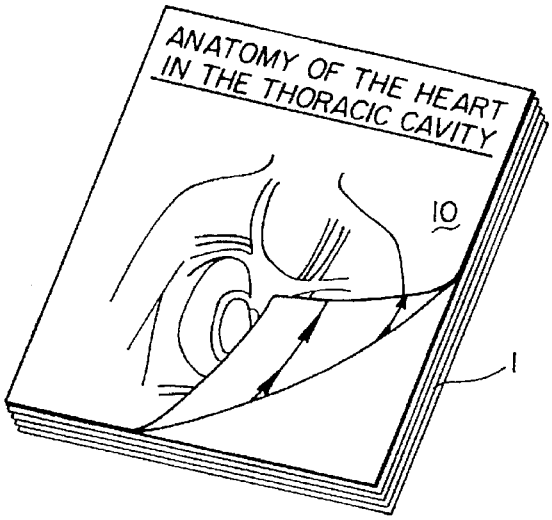
FIG. 6 illustrates a detail of the back of the label.
Figure 6B:
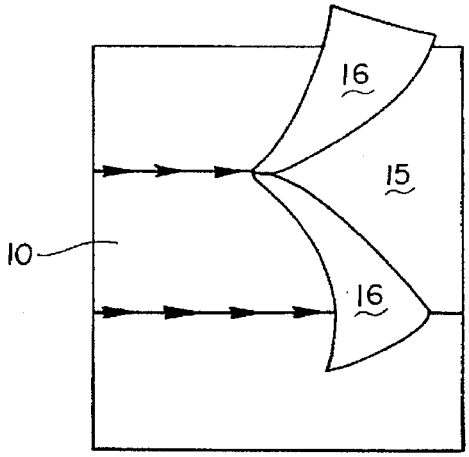

Referring now to FIG. 6, there is illustrated a blow-up of the method of attachment of the labels. The individual label, 10 is removed from the notepad, 1. The adhesive-backed label is produced by a conventional processing method whereby the adhesive-backed paper, 15 is covered by a sheet of waxy paper, cut at regular intervals, allowing the cut, wax-covered strips, 16 to be peeled from the label, and the adhesive-backed label to be affixed to the chart.

Figure 7A:
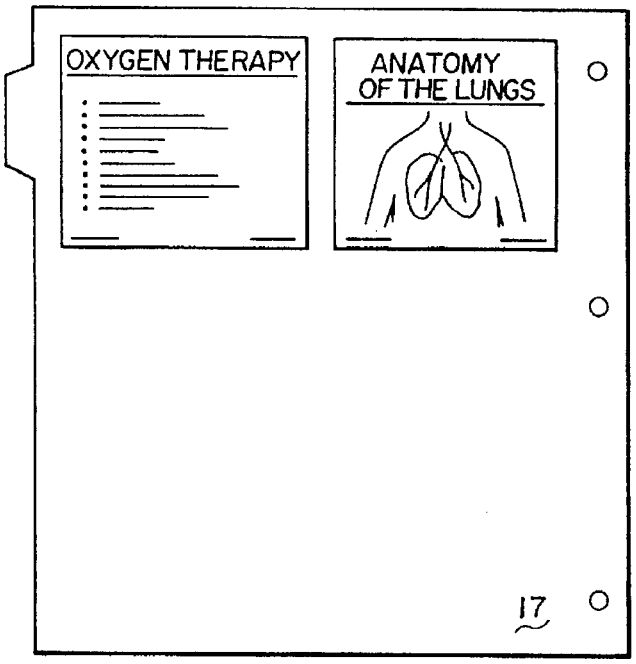
FIG. 7 illustrates the various locations of the labels in the patient's chart, including the chart divider, the nurse's notes, and the physician's progress notes.
Figure 7B:
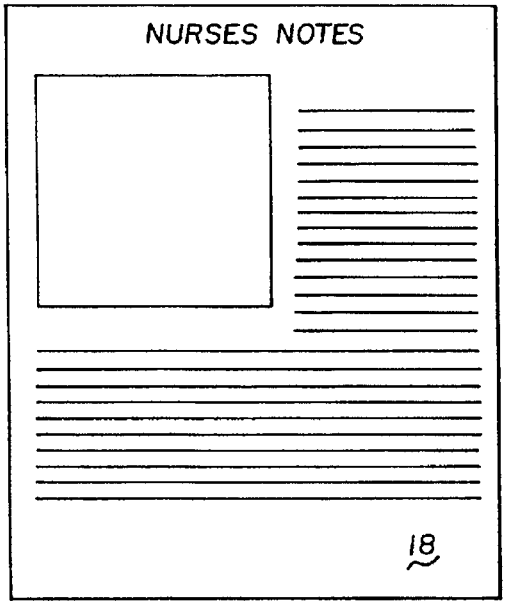
Figure 7C:
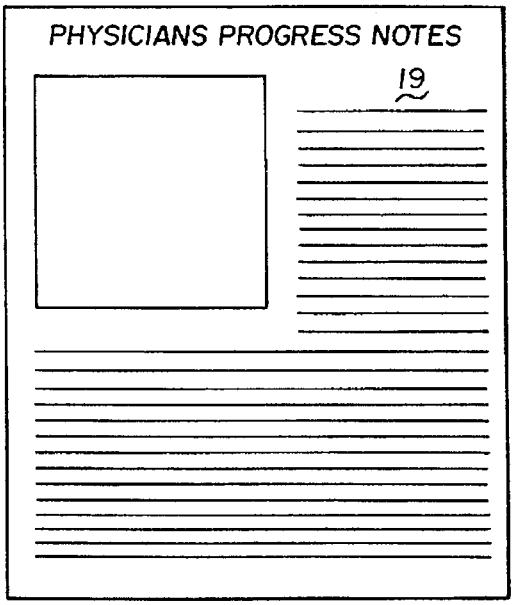

In operation, as illustrated in FIG. 7, the healthcare provider would remove the label from the appropriate notepad and attach the label to the chart divider 17, the nurse's notes 18, or the physician's progress notes 19. Thus, the labels replace hand drawn diagrams and serve as a reminder for assessment and documentation steps and appropriate medical terms. The labels would remain in the chart, providing a succinct and legible record of care for the patient.

Figure 8:
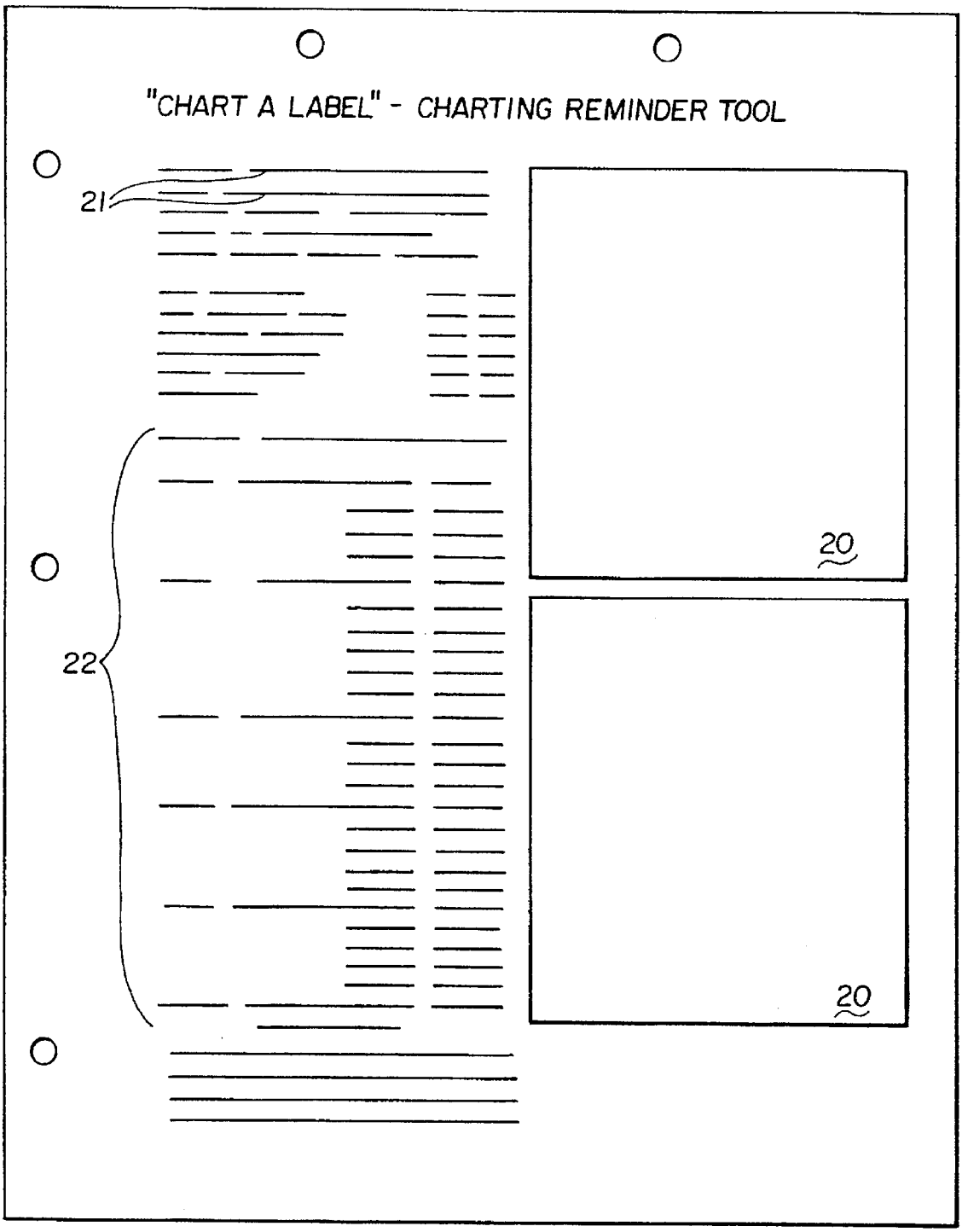
FIG. 8 illustrates a detail of the Charting Reminder Tool form.

Referring now to FIG. 8, the label may also be placed on the optional Charting Reminder Tool form, which is placed in the chart as a permanent record or for later removal after it is determined by the healthcare professional that the medical symptoms have been resolved, or the record is no longer necessary. As illustrated, the Charting Reminder Tool form includes bordered blank spaces, 20 for the necessary labels, along with spaces, 21 for the date of a procedure, the nurse's initials and the type of occurrence. In the preferred embodiment, the textual portion 22, of the Charting Reminder Tool form, is illustrated in Table 3:

TABLE 3

"CHART A LABEL" - CHARTING REMINDER TOOL

Date_____ Place Appropriate "Chart a Labels" Below
Client_____
Room Number_____

Reason for Follow-up
Every Shift Daily Weekly Monthly
(Circle One)

| | | |
|---|---|---|
| New Admission | Yes | No |
| Change of Condition | Yes | No |
| Acute Episode | Yes | No |
| Incident/Accident | Yes | No |
| Medicare | Yes | No |

Other_____

Date_____ Nurses Initials
day _____
evening _____
nights _____

Date_____ Nurses Initials
day _____
evening _____
nights _____

Date_____ Nurses Initials
day _____
evening _____
nights _____

Problem Resolved? Yes No

Notes
_____
_____
_____
_____
_____
_____
_____

After the label has been placed on the patient's chart, a nurse coming on a shift can very quickly determine if the chart is associated with an episode or follow-up Once this is determined, the nurse is provided a succinct checklist each time the patient is checked on. Therefore, it can be insured that the nurse has performed her job thoroughly since this checklist also provides the nurse with the appropriate medical terminology to enter into their notes. If the nurse requires any further information, the diagram label can be utilized to give the nurse some additional background. Prior to the present documentation system, the healthcare professional was required to hand write the information in the patient's chart, and hand draw the appropriate anatomical diagram. With the documentation system of the present invention, everything is provided to the nurse or medical professional in a very succinct manner. This allows the healthcare professional to save time while maintaining accurate, legible medical documentation.

In summary, there has been provided a documentation system for the health care industry which includes a plurality of notepads, each notepad containing 25 identical checklist or anatomical diagram labels associated with one of the body systems. Each of the checklist labels contains succinct assessment and/or diagnostic information. The anatomical diagram labels contain appropriate medical terminology identifying the various parts of the illustrated body system. The labels are removable and operable to be adhered to a patient's chart via the nurse's notes, the physician's progress notes, or the Charting Reminder Tool form. Once placed onto the patient's chart, the procedural tasks are outlined, which procedural tasks should be performed during any follow-up. Thus, the present invention provides for a very succinct documentation and professional assessment tool. In addition, the anatomical diagram labels are operable to be removed and given to the patient after an explanation of his medical condition and/or disease process. Thus, the anatomical diagram labels provide a legible and succinct method of patient teaching while saving time spent on hand drawings.

Although the preferred embodiment has been described in detail, it should be understood that various changes, substitutions and alterations can be made therein without departing from the spirit and scope of the invention as defined by the appended claims.

What is claimed is:

1. A documentation apparatus for use in association with a patient's medical chart, comprising:

a charting reminder sheet of paper, said sheet of paper containing a plurality of bordered blank spaces, a plurality of blank lines for date and signature, and a checklist explaining the need for follow-up;

a plurality of adhesive-backed labels, said labels containing predetermined assessment and documentation information associated with a separate and particular medical occurrence or disease process, and each said particular information label contained in an adhesive-bound notepad containing a plurality of identical medical information labels, and said medical information comprising either:

a predetermined anatomical diagram with associated medical reference terminology defined in text, or a checklist including predetermined documentation guidelines defined in text.

2. The documentation apparatus of claim 1 wherein each said label dimensioned to fit in the bordered blank space on the charting reminder sheet of paper.

3. The documentation apparatus of claim 1 wherein each said label contains a predetermined title associated with the checklist or anatomical diagram thereon.

4. The documentation apparatus of claim 1 wherein each of said checklist labels contains a plurality of predetermined documentation steps, each said textural description preceded by an indicator marker.

5. A temporary method for documenting care in a medical environment, and in association with a patient's medical chart, comprising:

defining a plurality of medical occurrences or disease processes, selecting a medical occurrence or disease process, selecting an associated body system, providing a plurality of charting reminder sheets of paper, each dimensional to fit in a patient's medical chart, providing on each charting reminder sheet a plurality of bordered blank spaces, providing a plurality of adhesive-backed labels in a notepad format, each label dimensioned to fit in the bordered blank spaces on the charting reminder sheet of paper, providing a plurality of checklist labels containing documentation steps in text relating to the selected medical occurrence or disease process, providing a plurality of anatomical labels, each containing an anatomical diagram of a particular body system and salient medical terminology for the associated medical occurrence or disease process, providing on each of the said labels a title of the associated medical occurrence, disease process, or body system, and removing the label from the notepad when follow-up for an acute episode, incident, or accident is presented, and attaching the removed label to the charting reminder sheet of paper, and inserting the charting reminder sheet of paper into the patient's medical chart for the duration of the follow-up procedure, and removing the charting reminder sheet of paper, with attached labels, when the follow-up procedure is completed.

6. A permanent method for documentation verification in a medical environment, and in association with a patient's chart, comprising:

defining a plurality of medical occurrences or disease processes, selecting a medical occurrence or disease process, selecting an associated body system, providing a plurality of adhesive-backed labels in a notepad format, each label dimensioned to fit in the physician's progress notes or the nurse's notes, and providing a plurality of checklist labels containing documentation steps in text relating to the selected medical occurrence or disease process, providing a plurality of anatomical labels, each containing an anatomical diagram of a particular body system and salient medical terminology for the associated medical occurrence or disease process, providing on each of the said labels a title of the associated medical occurrence, disease process, or body system, removing the label from the notepad when the need for documentation is presented attaching the removed label to the physician's progress notes or nurse's notes retaining the label in the chart as a permanent record of care.

7. A method of patient teaching in a medical environment, comprising:

defining a plurality of medical occurrences or disease processes, selecting a medical occurrence or disease process, selecting an associated body system, providing a plurality of anatomical labels, each containing an anatomical diagram of a particular body system and salient medical terminology for the associated medical occurrence or disease process, providing on each of the said labels a title of the associated medical occurrence, disease process, or body system, and removing the label from the notepad when the need to educate a patient arises, and giving the label to the patient after an explanation of his/her condition.

* * * * *